United States Patent [19]

Saulgeot

[11] Patent Number: 4,808,067

[45] Date of Patent: Feb. 28, 1989

[54] ROTARY VACUUM PUMP

[75] Inventor: Claude Saulgeot, Veyrier-Du-Lac, France

[73] Assignee: Alcatel Cit, Paris, France

[21] Appl. No.: 153,678

[22] Filed: Feb. 8, 1988

[30] Foreign Application Priority Data

Feb. 25, 1987 [FR] France ..... 87 02490

[51] Int. Cl.[4] ..... F04D 19/04

[52] U.S. Cl. ..... 415/90; 415/121 A; 55/439

[58] Field of Search ..... 415/90, 143, 121 R, 415/121 A, 168; 209/143; 55/199, 203, 439, 473, 423, 457

[56] References Cited

U.S. PATENT DOCUMENTS

| | | | |
|---|---|---|---|
| 1,958,145 | 5/1934 | Jones | 415/144 X |
| 2,370,778 | 3/1945 | Compton | 415/168 X |
| 2,732,032 | 1/1956 | Sandison | 415/168 X |
| 3,066,912 | 12/1962 | Scheper, Jr. | 415/121 A |
| 3,813,854 | 6/1974 | Hortman | 55/439 X |
| 3,827,482 | 7/1974 | Pope | 416/236 R X |
| 4,285,707 | 8/1981 | Pfenninger | 55/457 X |
| 4,512,725 | 4/1985 | Saulgeot | 415/90 X |

FOREIGN PATENT DOCUMENTS

| | | | |
|---|---|---|---|
| 542540 | 11/1955 | Belgium | 55/203 |
| 2310481 | 12/1976 | France . | |
| 109918 | 11/1974 | German Democratic Rep. . | |
| 132105 | 6/1929 | Switzerland . | |
| 2001707 | 2/1979 | United Kingdom | 415/121 A |

*Primary Examiner*—Robert E. Garrett
*Assistant Examiner*—Joseph M. Pitko
*Attorney, Agent, or Firm*—Sughrue, Mion, Zinn, Macpeak & Seas

[57] ABSTRACT

A rotary vacuum pump comprising a stator (1) and a rotor (2), the rotor being rotated inside the stator and the stator including a suction inlet (11) and an exhaust outlet orifice (12), wherein the suction end of the rotor carries at least one wheel (13) having sloping vanes (14) such that any solid particles that may be sucked in are projected thereby in a radial direction towards an annular stator collector tank (15) having a circular opening (16) opening out into the stator cavity (6) and situated in the plane in which said particles are projected by said vanes (14).

1 Claim, 1 Drawing Sheet

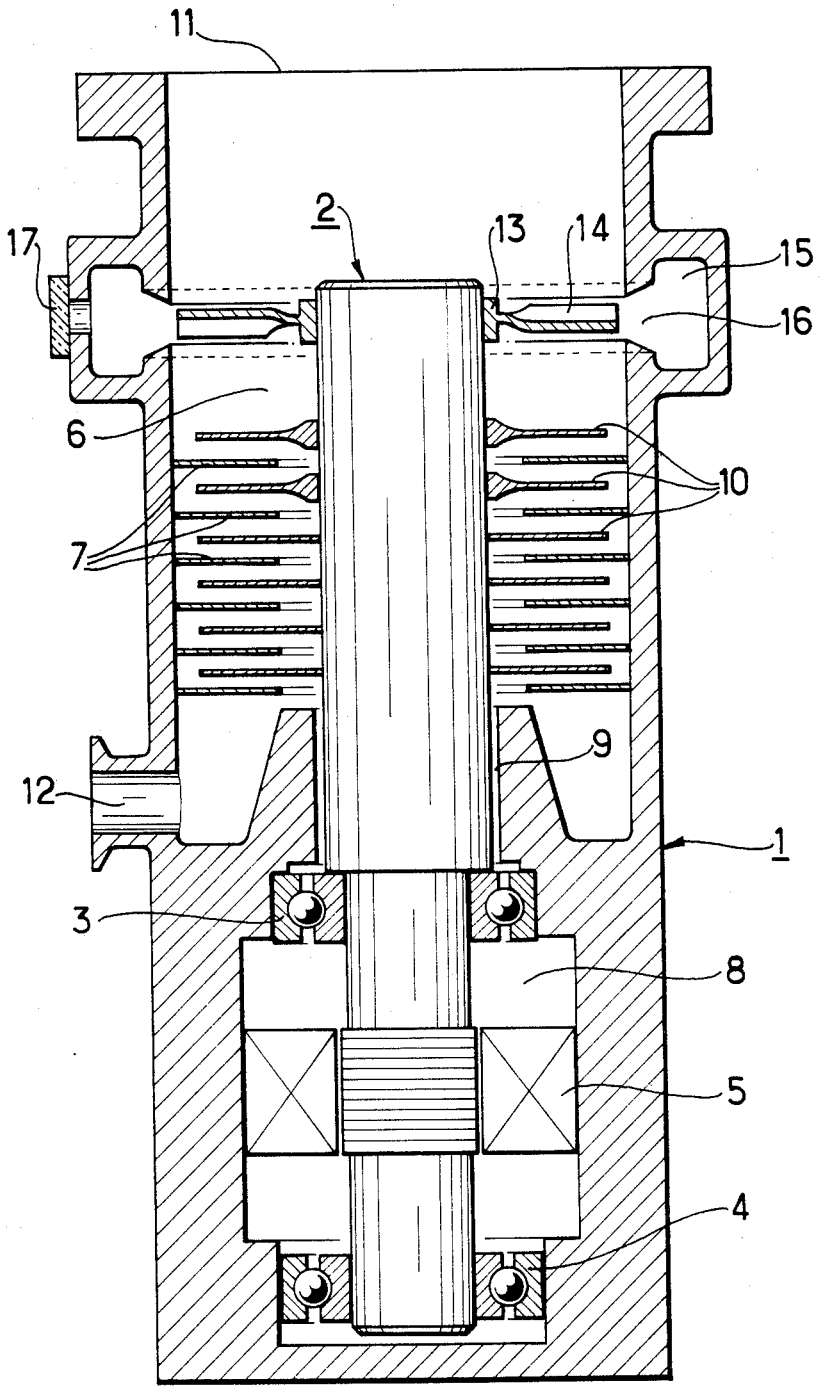
11
2
13
14
17
15
16
6
10
7
9
12
1
3
8
5
4

ROTARY VACUUM PUMP

The present invention relates to a rotary vacuum pump comprising a stator and a rotor, with the rotor being rotated inside the stator and with the stator having a suction inlet and an exhaust outlet.

BACKGROUND OF THE INVENTION

Such pumps, e.g. molecular pumps or turbomolecular pumps which can maintain pressures lying between 1 mb and $10^{-10}$ mb, rotate at very high speeds, and it is possible for the rotorsupporting bearings, and also for the gaps in the driving electric motor and in the dynamic seal separating the active portion of the pump from the portion containing the motor and the bearings all to be affected by the suction of very small physical particles which lead, in the end, to said members being damaged.

In order to avoid sucking in such particles, it is known that the pump suction inlet can be fitted with one or more filters constituted by very fine mesh metal gauze having a mesh of about 10 microns to 20 microns at most.

These filters do indeed stop such particles, however they have very low conductance. In this range of pressures, flow conditions are molecular or viscous, and as a result the molecular conductance of a filter pore is very low since this conductance is proportional to the cube of the pore diameter and inversely proportional to the pore length.

Such poor filter conductance considerably reduces the pumping rate of the pump. In addition to poor filter conductance, present filters clog rapidly, thereby quickly reducing pumping rates.

SUMMARY OF THE INVENTION

The present invention seeks to mitigate these drawbacks and provides a vacuum pump, e.g. a molecular or a turbomolecular pump as defined above, wherein the suction end of the rotor carries a least one wheel having sloping vanes, such that any solid particles that may be sucked in are projected thereby in a radial direction towards an annular stator collector tank having a circular opening opening out into the stator cavity and situated in the plane in which said particles are projected by said vanes.

BRIEF DESCRIPTION OF THE DRAWING

A particular and non-limiting example of an embodiment of the invention is described below with reference to the accompanying drawing in which the sole FIGURE is a diagrammatic section through a turbomolecular pump in accordance with the invention.

MORE DETAILED DESCRIPTION

In the example described, the pump is a vane pump, but the invention is also applicable to a Gaede channel type pump, such as a Holweck pump.

The turbomolecular pump shown comprises a stator 1 and a rotor 2 mounted inside the stator and supported to rotate in bearings 3 and 4. It is rotated by an electric motor 5.

The stator 1 is divided into two portions, with the first portion including a stator cavity 6 provided with a plurality of stages of fixed vanes 7 and with a second portion comprising a void 8 receiving the bearings 3 and 4, and the motor 5.

A sleeve 9 (which may optionally constitute a dynamic seal, particularly when the void 8 communicates with the outside), separates the stator cavity 6 from the void 8.

Inside the stator cavity 6, the rotor 2 has a series of rotor vane disks 10 which alternate with the fixed stator vane stages 7.

The stator 1 also includes a suction inlet 11 and an exhaust outlet 12.

According to the invention, in order to avoid sucking in solid particles, the end of the rotor 1 which is upstream from the vane disks 10 is provided with a wheel 13 having sloping vanes 14. The vanes 14 serve to project the particles radially by centrifugal force and the particles are collected in an annular collecting tank 15 in the stator 1, said tank being fitted with a circular opening 16 opening out into the stator cavity 6 in the plane in which the particles will be projected by the vanes.

In the example described, there is only one wheel 13, however there could optionally be a plurality of superposed wheels. The vanes 14 may be at a much greater angle of slope than the vanes of the suction stages 10. Depending on the nature, the mass, and the volume of the particles to be filtered, the vane wheel 13 may be fixed at various different distances from the first compression stage.

The inclination of the vanes 14 also depends on these parameters. The volume of the collector tank 15 may be such as to require emptying not more than once a year.

A porthole 17 serves to indicate the level to which the collector tank 15 is filled.

It is clear that the invention may be applied regardless of the way the rotor is mounted in the stator: it is applicable to a bell-type rotor or to a rotor as shown in the FIGURE, and it is also applicable regardless of the secondary arrangements that may be provided for bearing lubrication, for motor cooling, etc.

Further, the FIGURE is merely a diagram showing the general disposition of the assembly, and it is clear that the assembly of the stages 7 and the disks 10 is performed in the conventional manner which is well known to the person skilled in the art, and that the same is true for the wheel 13.

What is claimed is:

1. A rotary vacuum pump comprising a stator having a stator cavity, a rotor, and means mounting said rotor for rotation inside said stator cavity, said stator including a suction inlet, an exhaust outlet orifice and an annular stator collector tank disposed about said stator cavity and having a circular opening in communication with said stator cavity and said rotor including at least one wheel having sloping vanes disposed in a radial plane including said circular opening of said collector tank whereby any solid particles which may be sucked into said cavity will be projected radially outwardly by said vanes into said collector tank.

* * * * *